US006284348B1

(12) United States Patent
Suzuki et al.

(10) Patent No.: US 6,284,348 B1
(45) **Date of Patent: *Sep. 4, 2001**

(54) INK-JET PRINTING CLOTH, TEXTILE PRINTING PROCESS AND PRINT

(75) Inventors: Mariko Suzuki, Kawasaki; Masahiro Haruta, Tokyo; Shoji Koike, Yokohama; Koromo Shirota, Inagi; Aya Takaide, Yokohama; Tomoya Yamamoto, Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/915,317

(22) Filed: Aug. 20, 1997

Related U.S. Application Data

(63) Continuation of application No. 08/336,645, filed on Nov. 4, 1994, now abandoned.

(30) Foreign Application Priority Data

Nov. 8, 1993 (JP) ..... 5-278088

(51) Int. Cl.[7] ..... B41M 5/00

(52) U.S. Cl. ..... 428/195; 428/207; 8/125; 8/127; 8/445

(58) Field of Search ..... 8/125, 127, 445; 428/195, 207

(56) References Cited

U.S. PATENT DOCUMENTS 3,620,912 * 11/1971 Beelik et al. ..... 8/125

FOREIGN PATENT DOCUMENTS

| | | |
|---|---|---|
| 0553761 | 8/1993 | (EP) . |
| 0613975 | 9/1994 | (EP) . |
| 54059936 | 5/1979 | (JP) . |
| 61132687 | 6/1986 | (JP) . |
| 62053492 | 3/1987 | (JP) . |
| 62162086 | 7/1987 | (JP) . |
| 1005881 | 1/1989 | (JP) . |
| 64-5881 | 1/1989 | (JP) . |
| 2053976 | 2/1990 | (JP) . |
| 03046589 | 7/1991 | (JP) . |

OTHER PUBLICATIONS

H.K. Rouette, "Mercerisieren", *Lexikon für Textilveredlung*, Band 2, pp. 1211–1221, 1995.

"Mercerization and Causticizing", *Ullmann's Encyclopedia of Industrial Chemistry*, vol. A26, p. 264, sec. 4.2.2.6, 1995.

* cited by examiner

*Primary Examiner*—Pamela R. Schwartz
(74) *Attorney, Agent, or Firm*—Fitzpatrick, Cella, Harper & Scinto

(57) ABSTRACT

Disclosed herein is an ink-jet printing cloth composed of cellulose fibers, wherein the specific gravity of the cloth in an absolute dry condition is controlled within a range of from 1.45 to 1.49 by mercerization.

18 Claims, 3 Drawing Sheets

INK-JET PRINTING CLOTH, TEXTILE PRINTING PROCESS AND PRINT

This application is a continuation of application No. 08/336,645 filed Nov. 4, 1994, now abandoned.

BACKGROUND OF THE INVENTION

1. Field of the Invention

The present invention relates to an ink-jet printing cloth and a textile printing process. In particular, this invention relates to an ink-jet printing cloth which is composed mainly of cellulose fibers and can be dyed for obtaining highly colored, bright and fine patterns with high color yield upon formation of a printed image by an ink-jet system, a textile printing process using such a cloth, and prints provided by this process.

2. Related Background Art

At present, textile printing is principally conducted by screen printing or roller printing. Both methods require making a plate, and are hence unfit for multi-kind small-quantity production and difficult to quickly cope with the fashion of the day. Therefore, there has recently been a demand for development of an electronic printing system making no use of any plate. In compliance with this demand, many textile printing processes according to ink-jet recording have been proposed. Various fields expect much from such textile printing processes.

Ink-jet printing cloths used in such a system are required to have the following performance characteristics:

(1) being colored with an ink to a sufficient color depth;

(2) being dyed high in color yield with an ink;

(3) causing an ink on the cloth to quickly dry;

(4) causing little irregular bleeding of inks on the cloth;

(5) being excellent in feedability in apparatus; and (6) stably providing a print.

In order to satisfy these performance requirements, the surface of a cloth has heretofore been subjected to a pretreatment in advance, thereby coping with these requirements.

Cloths having an ink-receiving layer have been disclosed, for example, in Japanese Patent Application Laid-Open No. 62-53492, and cloths containing an antireducing agent and an alkaline substance therein have been proposed in Japanese Patent Publication No. 3-46589.

According to such pretreatments, considerable effects are partially recognized on the above requirements. However, whether a printed image after a final process is superior or inferior often still depends on the basic properties inherent in a cloth to be used. There is thus a problem that satisfactory cloths can not yet be obtained. As described above, means capable of satisfying the above individual performance characteristics to some extent have been able to be found in the prior art. However, there have not yet been known under the circumstances any ink-jet printing cloth and textile printing process which can satisfy all the above-mentioned performance characteristics at the same time, solve such a series of problems and provide the highest-quality image.

SUMMARY OF THE INVENTION

It is therefore an object of the present invention to provide an ink-jet printing cloth, which satisfies, at the same time, the above-described general problems involved in the conventional ink-jet printing cloths, i.e., a problem of dyeing technique that a bright print free of ink bleeding, and high in color depth is stably provided, a problem of cost that the color yield of ink is good, a problem of operating characteristics or properties such as ink-fixing ability and feedability in apparatus, etc., a textile printing process using such a cloth and a print provided by this process.

Such an object can be achieved by the present invention described below.

According to the present invention, there is thus provided an ink-jet printing cloth composed of cellulose fibers, wherein the specific gravity of the cloth in an absolute dry condition is adjusted within a range of from 1.45 to 1.49 by mercerization.

According to the present invention, there is also provided a textile printing process comprising applying a printing ink to a cloth by an ink-jet system, subjecting the cloth to a dyeing treatment and then washing the cloth thus treated, wherein said cloth is the ink-jet printing cloth described above.

According to the present invention, there is further provided a print produced by the textile printing process described above.

According to the present invention, there is still further provided a processed article obtained by further processing the print described above.

DESCRIPTION OF THE PREFERRED EMBODIMENTS

Figure 1:
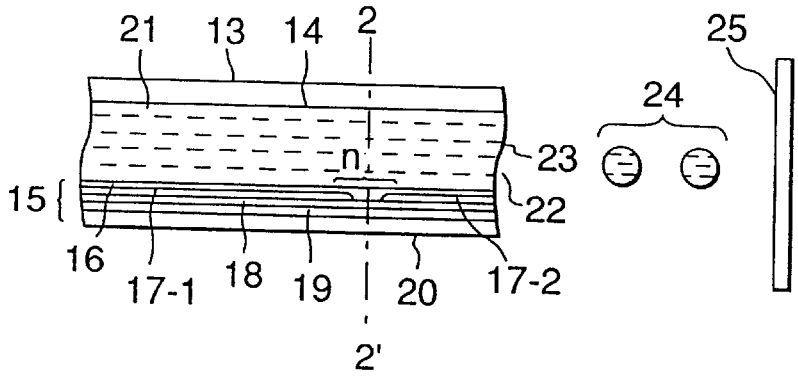
FIG. 1 is a longitudinal cross-sectional view of a head of an ink-jet recording apparatus.

The present inventors have carried out improvement in ink-jet printing cloths composed of cellulose fibers with a view toward allowing them to satisfy the various performance requirements as described above at the same time. As a result, it has been found that when the specific gravity of an untreated cloth in an absolute dry condition, which is one of basic properties of a base material, is adjusted within a certain range by regulating its degree of mercerization, in addition to improving methods such as the pretreatment of a cloth, which have been conducted to date, various characteristics or properties of the cloth, such as coloring ability, color yield, fixing ability, resistance to bleeding, stability and feedability can be improved to a marked extent.

The mercerization is a pretreatment in which cellulose fibers are swelled by a treatment with a strong alkali and part thereof are dissolved out to reduce their weight.

When the specific gravity of the fibers is reduced to 1.49 or lower by the mercerization, the relative area of a crystalline region at the surfaces of the fibers is decreased. In general, the OH groups in the fibers, which are reactive groups bonding to dyes, are strongly bonded to each other by interfiber hydrogen bonding. Therefore, their affinity for dyes is low. However, when the fibers are treated with the strong alkali and then neutralized, their hydrogen bond is loosened, and the affinity for dyes is thus improved, whereby the dyes become easy to penetrate the fibers. Accordingly, the fibers are improved in fixing ability and moreover made hard to cause irregular bleeding due to color mixing on the surfaces of the fibers.

Besides, the contact area between the dyes and the fibers are enlarged, and the color yield can be hence enhanced to provide a deep color. Such a cloth achieves about effective coloring, in particular, as a cloth for ink-jet printing conducted in a small shot-in dye quality, which is a great effect.

However, feedability is also an important performance property in cloths for ink-jet printing in which a cloth must be fed with high precision. In this respect, if the specific gravity of a cloth in an absolute dry condition reaches lower than 1.45 due to a too high degree of mercerization, the strength of the cloth becomes low, and it is not often that the cloth can be fed as desired.

From the above-described two points of view, there has been reached the conclusion that it is particularly preferable to control the specific gravity of the ink-jet printing cloth within a range of from 1.45 to 1.49 in an absolute dry condition.

The present invention will hereinafter be described in more detail by the following preferred embodiments.

The ink-jet printing cloth according to the present invention is a cloth composed of cellulose fibers. The cloth is characterized in that the specific gravity of the fibers in an absolute dry condition is controlled within a range of from 1.45 to 1.49 by mercerization.

The term "cellulose fibers" as used herein means fibers comprising cellulose as a principal component. Examples of such fibers include natural cellulose fibers such as cotton and hemp.

Of these, cotton which is a cellulose fiber derived from seeds of a plant is particularly preferred for use in the present invention.

The term "printing cloths" as used herein means woven fabrics, nonwoven fabrics, knitted fabrics, felted fabrics and the like. It goes without saying that the cloth is preferably formed of cellulose fibers alone. However, the cloth may contain one or more other materials within limits not impeding the effects of the present invention.

The specific gravity of the cloth in an absolute dry condition, which primarily characterizes the ink-jet printing cloth according to the present invention, is controlled within a range of from 1.45 to 1.49, preferably from 1.46 to 1.49 by mercerization. The mercerization is conducted by immersing a crude cloth in a 15 to 35% by weight aqueous solution of an alkali, for example, sodium hydroxide, at a temperature ranging from 20 to 30° C. for 30 seconds to 3 minutes. The mercerization is generally performed while the crude cloth is being kept under tension. However, the mercerization may be performed in a stage of yarn if necessary. It is more preferable to add a small amount of a surfactant to the treating solution when conducting the mercerization.

In this case, if the specific gravity of the cloth in an absolute dry condition is higher then 1.49, a crystalline region at the surfaces of the fibers becomes too great, whereby a dye in an ink is hard to penetrate the fibers though it varies according to inks to be used. Therefore, such a cloth is deteriorated in coloring ability, color yield, fixing ability, resistance to bleeding, stability and the like and may be disadvantageous to the provision of the highest-quality print in some cases. On the other hand, if the specific gravity in an absolute dry condition is lower than 1.45, the crystalline region becomes too small, whereby a problem may be offered from the viewpoint of feedability though it varies according to how the cloth is woven.

The measurement of specific gravities of the cloth and yarn according to the present invention is conducted in the following manner. A cloth or yarn sample in an absolute dry condition is cut, and the cut piece is immersed in carbon tetrachloride and made intimate with carbon tetrachloride. Thereafter, the piece is immersed in a standard solution obtained by mixing xylene having a specific gravity lower than that of water and carbon tetrachloride having a specific gravity higher than that of water in a proper proportion to determine the specific gravity of the cloth or yarn by whether the piece is settled or not.

When a water content in the cloth is adjusted within a range of from 13.5 to 108.5% by weight, preferably from 14.5 to 88.5% by weight, more preferably from 15.5 to 68.5% by weight as a preferred form of the present invention, the effects of the present invention are exhibited to a more marked extent.

The measurement of the water content in the cloth was conducted in accordance with JIS L 1019. More specifically, 100 g of a sample was precisely weighed and placed in an oven at 105±2° C., thereby drying the sample to a constant weight. The water content was then determined in accordance with the following equation:

$$\text{Water content } (\%)=\{(W-W')/W'\}\times 100$$

wherein W is a weight before the drying, and W' is a weight after the drying.

Alternatively, with respect to a cloth subjected to a pretreatment with an alkaline substance, which will be described subsequently, the cloth was dried to a constant weight. Thereafter, the cloth was washed with water and then dried again to a constant weight to measure the weight of fibers alone after the drying. The water content was then determined in accordance with the following equation:

$$\text{Water content } (\%)=\{(W-W')/W''\}\times 100$$

wherein W and W' have the same meaning as defined above, and W" is a weight of fibers after the water washing and drying.

As a preferred form of the ink-jet printing cloths according to the present invention, the average length of the cellulose fibers is preferably controlled within a range of from 25 to 60 mm, preferably from 30 to 55 mm, more preferably from 35 to 50 mm. Any average fiber length shorter than 25 mm results in a cloth having a disadvantage from the viewpoint of the occurrence of bleeding and definition. On the other hand, any average fiber length longer than 60 mm results in a cloth which may involve a problem from the viewpoint of feedability and color yield.

The average fiber length was determined by the staple diagram method in accordance with JIS L 1019.

Further, when the average thickness of the cellulose fibers falls within a range of from 0.6 to 2.2 deniers, the effects of the present invention are exhibited to a more marked extent.

More specifically, although it is only necessary for the average thickness to fall within the range of from 0.6 to 2.2 deniers, it is preferably within a range of from 0.7 to 2.0 deniers, more preferably from 0.8 to 1.8 deniers. Any average thickness of the fibers thinner than 0.6 denier results in a cloth which may decrease a color yield and may have an disadvantage from the viewpoint of feedability. On the other hand, any average thickness of the fibers exceeding 2.2 deniers results in a cloth which may involve a problem from the viewpoint of the occurrence of bleeding and definition.

With respect to the measurement of the average thickness of the fibers, their Micronaire fineness is determined by the Micronaire method, and the value is converted into the weight per 9000 m to express it in terms of a denier unit.

Besides the above-described constitutional requirements, as a preferred form of the ink-jet printing cloths according to the present invention, any pretreatment routinely used may be subjected on the cloths as needed. In particular, cloths containing at least one alkaline substance in an amount of 0.01 to 5% by weight based on the weight of the cloth in an absolute dry condition to control the water content in the cloth, or cloths containing at least one substance selected from the group consisting of water-soluble metal salts, water-soluble polymers, urea and thiourea in an amount of 0.01 to 20% by weight based on the weight of the cloth in an absolute dry condition to control the water content in the cloths are more preferred.

Examples of the alkaline substances used in the present invention include alkali metal hydroxides such as sodium hydroxide and potassium hydroxide; amines such as mono-, di- and triethanolamines; and alkali metal carbonates and bicarbonates such as sodium carbonate, potassium carbonate and sodium bicarbonate. Metal salts of organic acids such as calcium acetate and barium acetate, ammonia and ammonium compounds may also be mentioned. Further, sodium trichloroacetate and the like, which form an alkaline substance by steaming or under dry heat, may also be used. Sodium carbonate and sodium bicarbonate used in dyeing of reactive dyes are particularly preferred alkaline substances.

Examples of the water-soluble polymers include natural water-soluble polymers such as, for example, starches from corn, wheat and the like, cellulosic substances such as carboxymethylcellulose, methyl-cellulose and hydroxyethylcellulose, polysaccharides such as sodium alginate, gum arabic, locust bean gum, tragacanth gum, guar gum and tamarind seed, proteins such as gelatin and casein, tannin and derivatives thereof, and lignin and derivatives thereof. Examples of synthetic polymers include polyvinyl alcohol type compounds, polyethylene oxide type compounds, water-soluble acrylic polymers, water-soluble maleic anhydride polymers and the like. Of these, the polysaccharide polymers and cellulose polymers are preferred.

Examples of the water-soluble metal salts include compounds such as halides of alkali metals and alkaline earth metals, which form typical ionic crystals, and have a pH of 4 to 10. As representative examples of such compounds, may be mentioned NaCl, $Na_2SO_4$, KCl and $CH_3COONa$ for alkali metals, and $CaCl_2$ and $MgCl_2$ for alkaline earth metals. Of these, salts of Na, K and Ca are preferred.

The above is the outline of the ink-jet printing cloths according to the present invention.

No particular limitation is imposed on textile printing inks used for the ink-jet printing cloths according to the present invention so long as they can dye cellulose fibers. However, ink-jet printing inks composed of a reactive dye and an aqueous liquid medium may preferably be used.

Among others, the use of reactive dyes having a vinylsulfone group and/or a monochlorotriazine group in the inks can manifest the effects of the present invention to a more marked extent. Particularly preferable, specific examples of such dyes include those typified by C.I. Reactive Yellow 2, 15, 37, 42, 76, 85 and 95; C.I. Reactive Red 21, 22, 24, 31, 33, 45, 111, 112, 114, 180, 218 and 226; C.I. Reactive Blue 13, 15, 19, 21, 38, 49, 72, 77, 176, 203 and 220; C.I. Reactive Orange 5, 12, 13 and 35; C.I. Reactive Brown 7, 11, 33 and 46; C.I. Reactive Green 8 and 19; C.I. Reactive Violet 2, 6 and 22; and C.I. Reactive Black 1, 5, 8, 31 and 39. Other preferable dyes include reactive dyes having at least two reactive groups. Specific examples of these dyes include those having two or more reactive groups per dye molecule, typified by C.I. Reactive Yellow 168 and 175; C.I. Reactive Red 228 and 235; C.I. Reactive Blue 230 and 235; C.I. Reactive Orange 95; and C.I. Reactive Brown 37.

These dyes may be contained in an ink either singly or in any combination with dyes of the same or different hues. The total amount of the dyes to be used is generally within a range of from 5 to 30% by weight, preferably from 5 to 25% by weight, more preferably from 5 to 20% by weight based on the total weight of the ink.

It is also preferred embodiments to add a chloride ion and/or a sulfate ion to the ink used in the process of the present invention in a proportion of about 10 to 20,000 ppm based on the reactive dye(s) contained in the ink, and to add at least one substance selected from the group consisting of silicon, iron, nickel and zinc to the ink in a proportion of about 0.1 to 30 ppm in total. As a result, when ink-jet printing is conducted with such inks on the ink-jet printing cloth according to the present invention, a bright print high in color yield, free of any bleeding, and high in color depth can be obtained. In addition, the use of such inks permits textile printing which undergoes no clogging of orifices in a head over a long period of time, and is hence high in ejection performance.

Further, calcium and/or magnesium may preferably be contained in the ink in a total amount ranging from 0.1 to 30 ppm, preferably from 0.2 to 20 ppm, more preferably from 0.3 to 10 ppm in combination with the metal salts mentioned above because the color yield can be more enhanced.

Water which is an essential component of the liquid medium making up the ink used in the printing process of the present invention is used within a range of from 30 to 90% by weight, preferably from 40 to 90% by weight, more preferably from 50 to 85% by weight based on the total weight of the ink.

The above components are essential components to the ink-jet printing inks used in the process of the present invention. However, general organic solvents may also be used in combination with water as other components of the liquid medium for the inks. Examples thereof include ketones and keto-alcohols such as acetone and diacetone alcohol; ethers such as tetrahydrofuran and dioxane; addition polymers of oxyethylene or oxypropylene with diethylene glycol, triethylene glycol, tetraethylene glycol, dipropylene glycol, tripropylene glycol, polyethylene glycol, polypropylene glycol and the like; alkylene glycols the alkylene moiety of which has 2 to 6 carbon atoms, such as ethylene glycol, propylene glycol, trimethylene glycol, butylene glycol and hexylene glycol; triols such as 1,2,6-hexanetriol; thiodiglycol; glycerol; lower alkyl ethers of polyhydric alcohols, such as ethylene glycol monomethyl (or monoethyl) ether, diethylene glycol monomethyl (or monoethyl) ether and triethylene glycol monomethyl (or monoethyl) ether; lower dialkyl ethers of polyhydric alcohols, such as triethylene glycol dimethyl (or diethyl) ether and tetraethylene glycol dimethyl (or diethyl) ether; sulfolane; N-methyl-2-pyrrolidone; and 1,3-dimethyl-2-imidazolidinone.

The content of the water-soluble organic solvent as described above is generally within a range of from 0 to 50% by weight, preferably from 2 to 45% by weight based on the total weight of the ink.

The liquid medium components as described above may be used either singly or in any combination thereof if used in combination with water. However, the most preferred composition of the liquid medium is that comprising at least one polyhydric alcohol or a derivative thereof as such a solvent. Among others, diethylene glycol, triethylene glycol, triethylene glycol monomethyl ether, tetraethylene glycol dimethyl ether are particularly preferred.

The principal components of the inks used in the process of the present invention are as described above. However, as other ingredients for the aqueous liquid medium, may be added various kinds of dispersants, surfactants, viscosity modifiers, surface tension modifiers, optical whitening agents and the like as needed.

Examples thereof include viscosity modifiers such as polyvinyl alcohol, cellulosics and water-soluble resins; various kinds of anionic or nonionic surfactants; surface tension modifiers such as diethanolamine and triethanolamine; pH adjustors comprising a buffer solution; mildewproofing agents; and the like.

The above-described inks are used in recording apparatus one embodiment of which will be described subsequently, whereby preferred prints can be produced.

The textile printing process according to the present invention is a process in which the inks as described above are used to conduct textile printing on the ink-jet printing cloth according to the present invention. As the ink-jet recording system used for such textile printing, may be used any conventionally-known ink-jet recording system. However, the method described in, for example, Japanese Patent Application Laid-Open No. 54-59936, i.e., a system in which thermal energy is applied to an ink so as to undergo rapid volume change, and the ink is ejected from a nozzle by action force caused by this change of state is the most effective method. The reason is believed to be that if a recording head equipped with a plurality of nozzles is used, the above system is narrow in scattering of ejection velocities of the ink among individual nozzles, and the ejection velocities are converged within a range of from 5 to 20 m/sec. The degree of penetration of ink droplets into a cloth at the time an ink impacts the cloth at this velocity becomes optimum. Further, when the above-mentioned dyes suitable for use in the inks used in the present invention are used in such a system, neither deposition of foreign matter on a heating head nor disconnection occurs even if textile printing is conducted continuously for a long time. Therefore, the textile printing can be conducted stably.

As conditions under which the textile printing process according to the present invention can be effected with a particularly high effect by such an ink-jet recording system, it is preferred that an ejected ink droplet be within a range of from 20 to 200 pl, a shot-in ink quantity be within a range of from 4 to 40 nl/mm$^2$, a drive frequency be at least 1.5 kHz, and a head temperature be within a range of from 35 to 60° C.

As an illustrative example of an apparatus, which is suitable for use in conducting textile printing using the ink-jet printing cloth according to the present invention, may be mentioned an apparatus in which thermal energy corresponding to recording signals is applied to an ink within a recording head, and ink droplets are generated in accordance with the thermal energy.

Figure 2:
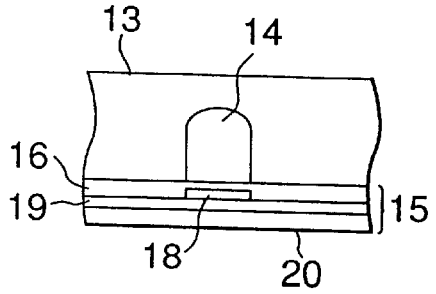
FIG. 2 is a transverse cross-sectional view of the head of the ink-jet recording apparatus.
Figure 3:
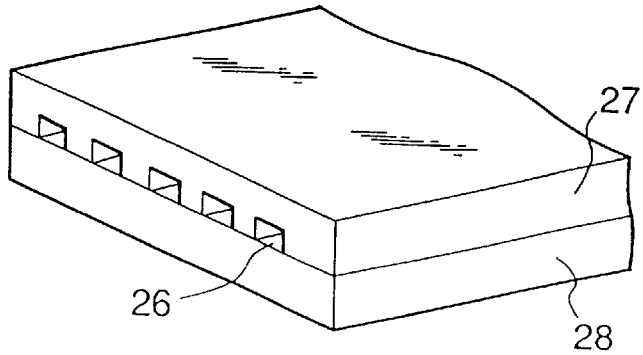
FIG. 3 is a perspective view of the appearance of a multi-head which is an array of such heads as shown in FIG. 1.

Examples of the construction of a head, which is a main component of such an apparatus, are illustrated in FIGS. 1, 2 and 3.

A head 13 is formed by bonding a glass, ceramic or plastic plate or the like having a groove 14 through which an ink is passed, to a heating head 15, which is used for thermal recording (the drawing shows a head to which the present invention, however, is not limited). The heating head 15 is composed of a protective film 16 made of silicon oxide or the like, aluminum electrodes 17-1 and 17-2, a heating resistor layer 18 made of nichrome or the like, a heat accumulating layer 19, and a substrate 20 made of alumina or the like having a good heat radiating property.

An ink 21 comes up to an ejection orifice (a minute opening) 22 and forms a meniscus 23 owing to a pressure P.

Now, upon application of electric signals to the electrodes 17-1, 17-2, the heating head 15 rapidly generates heat at the region shown by n to form bubbles in the ink 21 which is in contact with this region. The meniscus 23 of the ink is projected by the action of the pressure thus produced, and the ink 21 is ejected from the orifice 22 to a cloth 25 according to the present invention in the form of recording droplets 24. FIG. 3 illustrates a multi-head composed of an array of a number of heads as shown in FIG. 1. The multi-head is formed by closely bonding a glass plate 27 having a number of channels 26 to a heating head 28 similar to the head as illustrated in FIG. 1. Incidentally, FIG. 1 is a cross-sectional view of the head 13 taken along the flow path of the ink, and FIG. 2 is a cross-sectional view taken along line 2–2' in FIG. 1.

Figure 4:
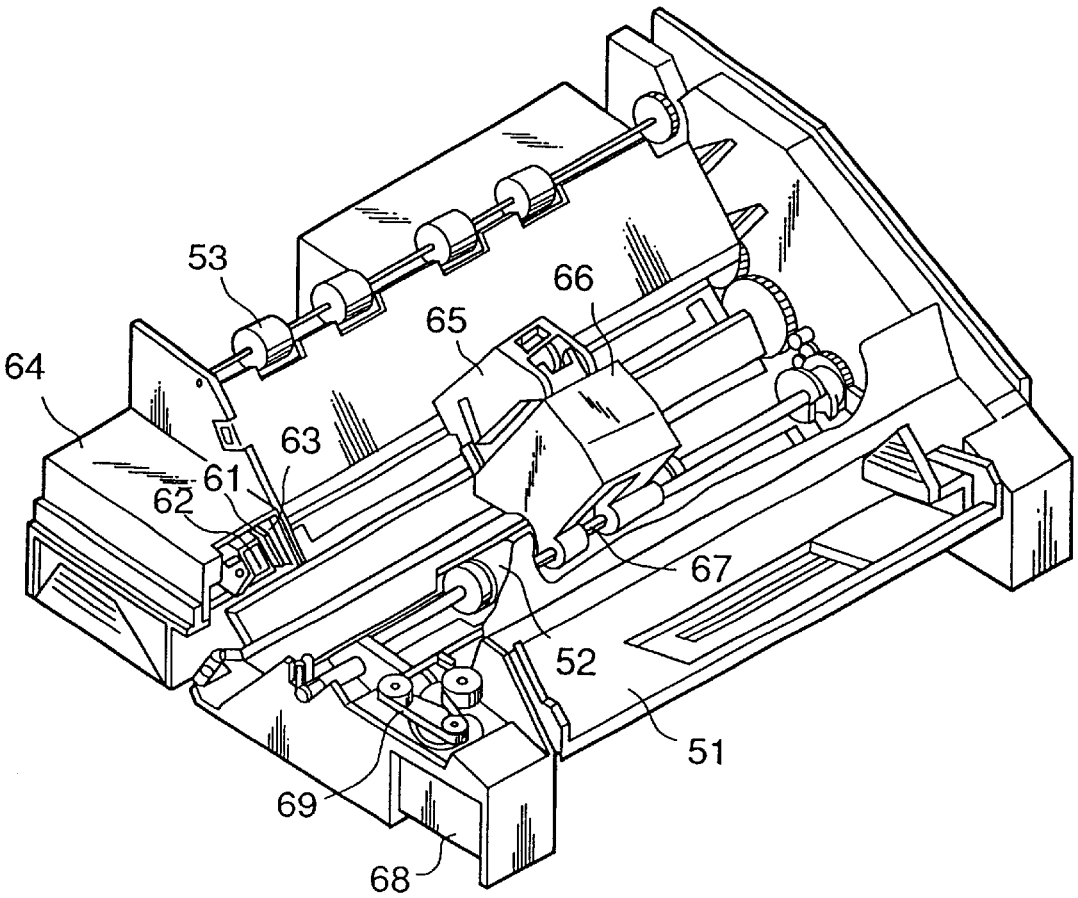
FIG. 4 is a perspective view of an illustrative ink-jet recording apparatus.

FIG. 4 illustrates an example of an ink-jet recording apparatus in which such a head has been incorporated.

In FIG. 4, reference numeral 61 designates a blade serving as a wiping member, one end of which is a stationary end held by a blade-holding member to form a cantilever. The blade 61 is provided at the position adjacent to the region in which a recording head operates, and in this embodiment, is held in such a form that it protrudes to the route through which the recording head is moved. Reference numeral 62 indicates a cap, which is provided at the home position adjacent to the blade 61, and is so constituted that it moves in the direction perpendicular to the direction in which the recording head is moved and comes into contact with the face of ejection openings to cap it. Reference numeral 63 denotes an absorbing member provided adjoiningly to the blade 61 and, similar to the blade 61, is held in such a form that it protrudes into the route through which the recording head is moved. The above-described blade 61, cap 62 and absorbing member 63 constitute an ejection-recovery portion 64, where the blade 61 and absorbing member 63 remove off water, dust and/or the like from the face of the ink-ejecting openings.

Reference numeral 65 designates the recording head having an ejection-energy-generating means and serving to eject the ink onto a cloth set in an opposing relation with the ejection opening face provided with ejection openings to conduct recording. Reference numeral 66 indicates a carriage on which the recording head 65 is mounted so that the recording head 65 can be moved. The carriage 66 is slidably interlocked with a guide rod 67 and is connected (not illustrated) at its part to a belt 69 driven by a motor 68. Thus, the carriage 66 can be moved along the guide rod 67 and hence, the recording head 65 can be moved from a recording region to a region adjacent thereto.

Reference numerals 51 and 52 denote a cloth feeding part from which the cloths are separately inserted, and cloth feed rollers driven by a motor (not illustrated), respectively. With such construction, the cloth is fed to the position opposite to the ejection opening face of the recording head, and discharged from a cloth discharge section provided with cloth discharge rollers 53 with the progress of recording. In the above constitution, the cap 62 in the head recovery portion 64 is receded from the moving route of the recording head 65 when the recording head 65 is returned to its home position, for example, after completion of recording, and the blade 61 remains protruded into the moving route. As a result, the ejection opening face of the recording head 65 is wiped. When the cap 62 comes into contact with the ejection opening face of the recording head 65 to cap it, the cap 62 is moved so as to protrude into the moving route of the recording head.

When the recording head 65 is moved from its home position to the position at which recording is started, the cap 62 and the blade 61 are at the same positions as the positions upon the wiping as described above. As a result, the ejection opening face of the recording head 65 is also wiped at the time of this movement.

The above movement of the recording head to its home position is made not only when the recording is completed or the recording head is recovered for ejection, but also when the recording head is moved between recording regions for the purpose of recording, during which it is moved to the home position adjacent to each recording region at given intervals, where the ejection opening face is wiped in accordance with this movement.

Figure 5:
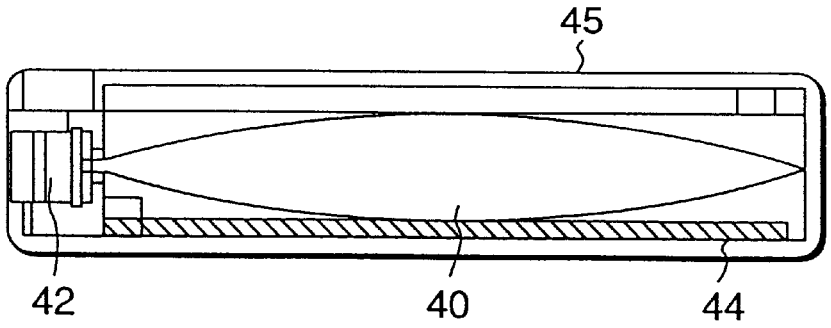
FIG. 5 is a longitudinal cross-sectional view of an ink cartridge.

FIG. 5 illustrates an exemplary ink cartridge 45 in which an ink to be fed to the head through an ink-feeding member, for example, is contained in a tube. Here, reference numeral 40 designates an ink container portion containing the ink to be fed, as exemplified by a bag for the ink. One end thereof is provided with a stopper 42 made of rubber. A needle (not illustrated) may be inserted into this stopper 42 so that the ink in the bag 40 for the ink can be fed to the head. Reference numeral 44 indicates an ink-absorbing member for receiving a waste ink. In this invention, it is preferable that the ink container portion be formed of a polyolefin, in particular, polyethylene, at its surface with which the ink comes into contact. The ink-jet recording apparatus used in the present invention is not limited to the apparatus as described above in which the head and the ink cartridge are separately provided. Therefore, a device in which these members are integrally formed as shown in FIG. 6 can also be preferably used.

Figure 6:
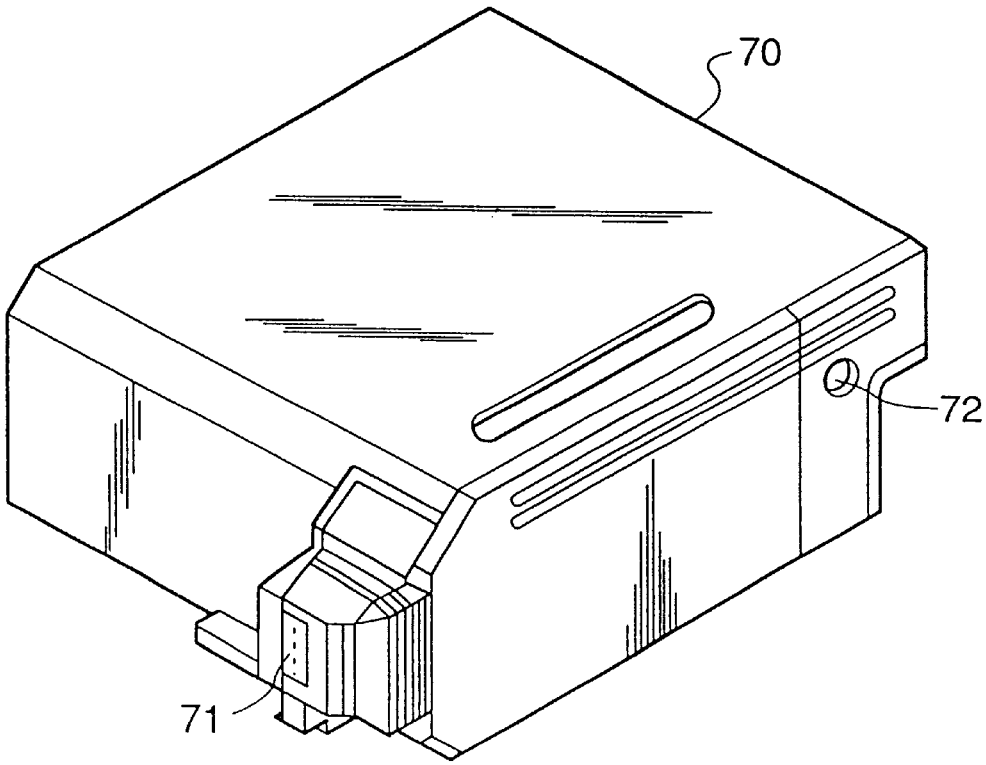
FIG. 6 is a perspective view of a recording unit.

In FIG. 6, reference numeral 70 designates a recording unit, in the interior of which an ink container portion containing an ink, for example, an ink-absorbing member, is contained. The recording unit 70 is so constructed that the ink in such an ink-absorbing member is ejected in the form of ink droplets through a head 71 having a plurality of orifices. In the present invention, polyurethane is preferably used as a material for the ink-absorbing member. Reference numeral 72 indicates an air passage for communicating the interior of the recording unit with the atmosphere. This recording unit 70 can be used in place of the printing head shown in FIG. 4, and is detachably installed on the carriage 66.

The printing inks applied onto the ink-jet printing cloth of this invention in accordance with the process of the present invention in the above-described manner only adhere to the cloth in this state. Accordingly, it is preferable to subsequently subject the cloth to a process for reactively fixing the dyes in the inks to the fibers and a process for removing unfixed dyes. Such reactive fixing and removal of the unreacted dyes may be conducted in accordance with any conventionally-known method. Such a treatment may be conducted in accordance with the conventionally-known method in which the printed cloth is treated, for example, by a steaming process, an HT steaming process or a thermofix process, or in case the cloth used has not been pretreated with an alkali, by an alkaline pad-steam process, an alkaline blotch-steam process, an alkaline shock process or an alkaline cold fix process, and then washed.

The thus-obtained print can be cut into desired sizes as needed, and the cut pieces can then be subjected to processes required to obtain final processed articles, such as sewing, bonding and/or welding, thereby obtaining the processed articles such as neckties or handkerchiefs.

EXAMPLES

The present invention will hereinafter be described more specifically by the following Examples and Comparative Examples. Incidentally, all designations of "part" or "parts" and "%" as will be used in the following examples mean part or parts by weight and % by weight unless expressly noted otherwise.

| Preparation of Ink (A): | |
|---|---|
| Reactive Dye (C.I. Reactive Yellow 95) | 10 parts |
| Thiodiglycol | 24 parts |
| Diethylene glycol | 11 parts |
| Potassium chloride | 0.004 part |
| Sodium sulfate | 0.002 part |
| Sodium metasilicate | 0.001 part |
| Iron chloride | 0.0005 part |
| Water | 55 parts. |

All the above components were mixed, and the resultant liquid mixture was adjusted to pH 8.4 with sodium hydroxide, stirred for 2 hours and then filtered through a "Fluoropore Filter FP-100" (trade name; product of Sumitomo Electric Industries, Ltd.), thereby obtaining Ink-Jet Printing Ink (A).

| Preparation of Ink (B): | |
|---|---|
| Reactive Dye (C.I. Reactive Red 24) | 10 parts |
| Thiodiglycol | 15 parts |
| Diethylene glycol | 10 parts |
| Tetraethylene glycol dimethyl ether | 5 parts |
| Potassium chloride | 0.04 part |
| Sodium sulfate | 0.01 part |
| Sodium metasilicate | 0.001 part |
| Iron chloride | 0.0005 part |
| Nickel chloride | 0.0002 part |
| Water | 60 parts. |

All the above components were mixed, and the resultant liquid mixture was adjusted to pH 7.9 with sodium hydroxide, stirred for 2 hours and then filtered through a "Fluoropore Filter FP-100" (trade name; product of Sumitomo Electric Industries, Ltd.), thereby obtaining Ink-Jet Printing Ink (B).

| Preparation of Ink (C): | |
|---|---|
| Reactive Dye (C.I. Reactive Blue 72) | 13 parts |
| Thiodiglycol | 23 parts |
| Triethylene glycol monomethyl ether | 6 parts |
| Potassium chloride | 0.05 part |
| Sodium metasilicate | 0.001 part |
| Iron chloride | 0.0005 part |
| zinc chloride | 0.0003 part |
| Water | 58 parts. |

All the above components were mixed, and the resultant liquid mixture was adjusted to pH 8.3 with sodium hydroxide, stirred for 2 hours and then filtered through a "Fluoropore Filter FP-100" (trade name; product of Sumitomo Electric Industries, Ltd.), thereby obtaining Ink-Jet Printing Ink (C).

| Preparation of Ink (D): | |
|---|---|
| Reactive Dye (C.I. Reactive Brown 11) | 2 parts |
| Reactive Dye (C.I. Reactive Orange 12) | 1.5 parts |
| Reactive Dye (C.I. Reactive Black 39) | 6.5 parts |
| Thiodiglycol | 23 parts |
| Diethylene glycol | 5 parts |
| Isopropyl alcohol | 3 parts |
| Potassium sulfate | 0.01 part |
| Sodium metasilicate | 0.001 part |
| Iron sulfate | 0.0005 part |
| Nickel sulfate | 0.0003 part |
| Zinc sulfate | 0.0003 part |
| Water | 59 parts. |

All the above components were mixed, and the resultant liquid mixture was adjusted to pH 8.2 with sodium hydroxide, stirred for 2 hours and then filtered through a "Fluoropore Filter FP-100" (trade name; product of Sumitomo Electric Industries, Ltd.), thereby obtaining Ink-Jet Printing Ink (D).

EXAMPLE 1

A 100% cotton woven fabric formed of American raw cotton having an average fiber length of 40 mm and an average thickness of 1.0 denier was treated with a 20% aqueous solution of sodium hydroxide and 1% Mercerine HSO (product of Meisei Chemical Co., Ltd.) at 25° C. under tension to control its specific gravity to 1.47. After the thus-treated fabric was neutralized with an acid and washed with water, it was immersed in an aqueous solution containing 10% of urea and 5% of sodium carbonate, followed by regulation of its pickup and drying conditions to give a water content of 20%.

Ink-Jet Printing Inks (A through D) obtained in the above-described manner were charged in a "Color Bubble Jet Copier PIXEL PRO" (trade name, manufactured by Canon Inc.) to print solid print samples of 2×10 cm on this woven fabric under conditions of a shot-in ink quantity of 16 nl/mm$^2$. The solid print samples were fixed by a steam treatment at 100° C. for 2 minutes. Thereafter, these print samples were washed with a neutral detergent to evaluate them in brightness, resistance to bleeding and dyeing property. The results are shown in Table 1.

EXAMPLE 2

A 100% cotton woven fabric formed of American raw cotton having an average fiber length of 40 mm and an average thickness of 1.5 deniers was treated with a 30% aqueous solution of sodium hydroxide and 1% Mercerin HSO at 25° C. under tension to control its specific gravity to 1.45. After the thus-treated fabric was neutralized with an acid and washed with water, it was immersed in an aqueous solution containing 10% of urea and 5% of sodium carbonate, followed by regulation of its pickup and drying conditions to give a water content of 20%.

Using this woven fabric, printing was conducted in the same manner as in Example 1 to evaluate the resulting print samples in brightness, resistance to bleeding and dyeing property. The results are shown in Table 1.

EXAMPLE 3

A 100% cotton woven fabric formed of American raw cotton having an average fiber length of 40 mm and an average thickness of 1.5 deniers was treated with a 20% aqueous solution of sodium hydroxide and 1% Mercerin HSO at 25° C. under tension to control its specific gravity to 1.49. After the thus-treated fabric was neutralized with an acid and washed with water, it was immersed in an aqueous solution containing 10% of urea and 5% of sodium hydrogen-carbonate, followed by regulation of its pickup and drying conditions to give a water content of 20%.

Using this woven fabric, printing was conducted in the same manner as in Example 1 to evaluate the resulting print samples in brightness, resistance to bleeding and dyeing property. The results are shown in Table 1.

Comparative Example 1

A 100% cotton woven fabric formed of American raw cotton having an average fiber length of 40 mm and an average thickness of 1.0 denier was treated with a 20% aqueous solution of sodium hydroxide and 1% Mercerin HSO at 25° C. under tension to control its specific gravity to 1.50. After the thus-treated fabric was neutralized with an acid and washed with water, it was immersed in an aqueous solution containing 10% of urea and 5% of sodium carbonate, followed by regulation of its pickup and drying conditions to give a water content of 20%.

Using the same Ink-Jet Printing Inks (A through D) as those used in the examples, printing was conducted on this woven fabric in the same manner as described above to evaluate the resulting print samples in brightness, resistance to bleeding and dyeing property. The results are shown in Table 1.

Comparative Example 2

A 100% cotton woven fabric formed of American raw cotton having an average fiber length of 40 mm and an average thickness of 1.0 denier was treated with a 30% aqueous solution of sodium hydroxide and 1% Mercerin HSO at 25° C. under tension to control its specific gravity to 1.44. After the thus-treated fabric was neutralized with an acid and washed with water, it was immersed in an aqueous solution containing 10% of urea and 5% of sodium carbonate, followed by regulation of its pickup and drying conditions to give a water content of 20%.

Using the same Ink-Jet Printing Inks (A through D) as those used in the examples, printing was conducted on this woven fabric in the same manner as described above to evaluate the resulting print samples in brightness, resistance to bleeding and dyeing property. The results are shown in Table 1.

Incidentally, the woven fabric involved a problem of delivery accuracy from the viewpoint of feedability compared with that in Example 1.

TABLE 1

| Evaluated | Example | | | Comp. Example | |
|---|---|---|---|---|---|
| Item | 1 | 2 | 3 | 1 | 2 |
| Brightness*1 | A | A | A | B | A |
| Resistance to*2 bleeding | A | A | A | B | C |
| Dyeing property*3 | A | A | A | C | A |

*1A 100% cotton woven fabric formed of American raw cotton having an average fiber length of 40 mm and an average thickness of 1.0 denier was immersed in an aqueous solution containing 10% of urea and 5% of sodium carbonate without adjusting its specific gravity by mercerization, followed by regulation of its pickup and drying conditions to give a water content of 20%. Printing was conducted on the thus-treated woven fabric in the same manner as in the examples. The reflectances of the resulting print samples at a maximum absorption wavelength were measured to take an average value thereof as 1. Similarly, the reflectances of the print samples at a maximum absorption wavelength in each of the examples and comparative examples were measured to compare their average value with the reference average. The brightness was ranked in accordance with the following standard: A: Smaller than 0.95; B: 0.95 to 1.0; and C: Larger than 1.0.

*2Irregularity of straight areas at edges was observed with naked eyes to rank the resistance to bleeding in accordance with the following standard: A: No irregularity was observed; B: Slight irregularity was observed; and C: Marked irregularity was observed.

*3The finished print samples were washed further with hot water at 80° C. to observe whether the dyes separated out or not. The dyeing property was ranked in accordance with the following standard: A: No separation of the dyes was observed; B: Slight separation of the dyes was observed; and C: Marked separation of the dyes was observed.

According to the ink-jet printing cloths of the present invention, as described above, bright prints free of bleeding, and high in color depth can be obtained stably. Besides, the textile printing process according to the present invention is excellent in ink-fixing ability and feedability of the cloths in apparatus, and hence permits the effective provision of excellent prints.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded to the broadest interpretation so as to encompass all such modifications and equivalent structures and functions.

What is claimed is:

1. An ink-jet printing cloth composed of cotton fibers having an average length of 25 to 60 mm and an average thickness of 0.6 to 2.2 deniers, wherein the specific gravity of the cloth in an absolutely dry condition is adjusted within a range of 1.45 to 1.49 by mercerization and wherein the amount of an alkaline substance in the cloth is adjusted within a range of from 0.01 to 5% by weight based on the weight of the cloth in an absolutely dry condition by treating the mercerized and then washed cloth with an alkaline solution.

2. The ink-jet printing cloth according to claim 1, wherein the cloth is a 100% cotton cloth.

3. The ink-jet printing cloth according to claim 1, wherein the cloth has a water content of 13.5 to 108.5%.

4. The ink-jet printing cloth according to claim 1, wherein the cloth contains at least one substance selected from the group consisting of water-soluble metal salts, water-soluble polymers, urea and thiourea in an amount of 0.01 to 20% by weight based on the weight of the cloth in an absolutely dry condition.

5. The ink-jet printing cloth according to claim 1, wherein the alkaline solution contains at least one substance selected from the group consisting of alkali metal hydroxides, amines, alkali metal carbonates and alkali metal bicarbonates.

6. The ink-jet printing cloth according to claim 1, wherein the alkaline solution contains at least one of the alkali metal carbonates and alkali metal bicarbonates.

7. The ink-jet printing cloth according to claim 6, wherein the alkaline solution contains at least one of sodium carbonate and sodium bicarbonate.

8. A print produced by a textile printing process comprising applying a printing ink to a cloth by an ink-jet system, subjecting the cloth to a dyeing treatment and then washing the cloth thus treated, wherein said cloth is an ink-jet printing cloth composed of cotton fibers having an average length of 25 to 60 mm and an average thickness of 0.6 to 2.2 deniers, wherein the specific gravity of the cloth in an absolutely dry condition is adjusted within a range of from 1.45 to 1.49 by mercerization, and wherein the amount of an alkaline substance in the cloth is adjusted within a range of from 0.01 to 5% by weight based on the weight of the cloth in an absolutely dry condition by treating the mercerized and then washed cloth with an alkaline solution.

9. A processed article obtained by further processing the print according to claim 8.

10. The processed article according to claim 9, which is obtained by cutting the print into desired sizes and subjecting the cut pieces to a process required to obtain a final processed article.

11. The processed article according to claim 10, wherein the process required to obtain the final processed article is sewing.

12. The print according to claim 8, wherein the alkaline solution contains at least one substance selected from the group consisting of alkali metal hydroxides, amines, alkali metal carbonates and alkali metal bicarbonates.

13. The print according to claim 8, wherein the alkaline solution contains at least one of the alkali metal carbonates and alkali metal bicarbonates.

14. The print according to claim 13, wherein the alkaline solution contains at least one of sodium carbonate and sodium bicarbonate.

15. A method of preparing an ink-jet printing cloth comprising the steps of:

providing a cloth composed of cotton fibers having an average length of 25 to 60 mm and an average thickness of 0.6 to 2.2 deniers; and adjusting the specific gravity of the cloth in an absolutely dry condition within a range of from 1.45 to 1.49 by mercerization, and adjusting the amount of alkaline substance in the cloth within a range of from 0.01 to 5% by weight based on the weight of the cloth in an absolutely dry condition by treating the mercerized and then washed cloth with an alkaline solution.

16. The method according to claim 15, wherein the alkaline solution contains at least one substance selected from the group consisting of alkali metal hydroxides, amines, alkali metal carbonates and alkali metal bicarbonates.

17. The method according to claim 15, wherein the alkaline solution contains at least one of the alkali metal carbonates and alkali metal bicarbonates.

18. The method according to claim 17, wherein the alkaline solution contains at least one of sodium carbonate and sodium bicarbonate.

* * * * *

UNITED STATES PATENT AND TRADEMARK OFFICE

CERTIFICATE OF CORRECTION

PATENT NO. : 6,284,348 B1
DATED : September 4, 2001
INVENTOR(S) : Mariko Suzuki et al.

It is certified that error appears in the above-identified patent and that said Letters Patent is hereby corrected as shown below:

Title page,
Item [56], References Cited, FOREIGN PATENT DOCUMENTS, "54059936" shoud read -- 54-059936 --; and "61132687" should read -- 61-132687 --; and "62053492" should read -- 62-053492 --; and "62162086" should read -- 62-162086 --; and "1005881" should read -- 1-005881 --; and "2053976" should read -- 2-053976 --; and "03046589" should read -- 3-046589 --.

Column 11,
Line 50, "fixed by" should read -- subjected to --
Line 51, "minutes." should read -- minutes to fix the dye. --

Signed and Sealed this

Fourth Day of June, 2002

*Attest:*

*Attesting Officer*

JAMES E. ROGAN
*Director of the United States Patent and Trademark Office*